United States Patent [19]

Frye et al.

[11] 4,410,122

[45] Oct. 18, 1983

[54] DEVICE FOR WIDTHWISE CONTROL OF WEB MATERIAL AND METHOD

[75] Inventors: Kenneth G. Frye, South Egremont; Donald Gangemi, Great Barrington, both of Mass.

[73] Assignee: Beloit Corporation, Beloit, Wis.

[21] Appl. No.: 268,788

[22] Filed: Jun. 1, 1981

[51] Int. Cl.[3] ..... B65H 35/02; B65H 23/32

[52] U.S. Cl. ..... 226/199; 26/102

[58] Field of Search ..... 226/199, 196, 197, 198, 226/194; 26/51, 51.3, 101, 102; 242/76

[56] References Cited

U.S. PATENT DOCUMENTS

| | | | |
|---|---|---|---|
| 3,463,377 | 8/1969 | Lucas | 226/197 |
| 3,645,433 | 2/1972 | Lucas et al. | 226/190 |
| 3,765,616 | 10/1973 | Hutzenlaub et al. | 226/199 X |
| 3,786,975 | 1/1974 | Heymanns | 226/194 |
| 3,848,304 | 11/1974 | Lucas | 29/116 AD |

*Primary Examiner*—John M. Jillions
*Assistant Examiner*—Scott J. Haugland
*Attorney, Agent, or Firm*—Hill, Van Santen, Steadman & Simpson

[57] ABSTRACT

A device for widthwise control of web material, comprises bar structure having resiliently bendable beam means for effecting a primary bowed adjustment. A set of side-by-side independent but cooperative wrap area members are carried by the beam means and are adapted to be individually selectively adjustable relative to the beam means to effect secondary adjustments incrementally at any of the members, without altering the primary bow relation, for correctionally compensating for uneven tension in any part of the web material, such as may be caused by web thickness, bulk or length.

33 Claims, 5 Drawing Figures

HYDRAULIC SYSTEM

WS

DEVICE FOR WIDTHWISE CONTROL OF WEB MATERIAL AND METHOD

This invention relates to a device for widthwise control of web material, and method of operating the same and is particularly concerned with improving the versatility of such a device.

In the production of sheet material, such as paper, large machines are often used to produce the sheet product. In view of the large size of the machinery, the sheet is frequently quite large and very often too large to be utilized directly. In the manufacture of paper, it is not unusual to produce paper in the form of a roll having a width of 30 feet and a diameter of 9 feet. Paper rolls of this size are not normally directly usable. For example, in the case of newsprint, the rolls used by the printers are generally much smaller both in width and in diameter.

While in the foregoing paragraph and hereinafter, reference may be made to paper, it is to be understood that although the invention has particular suitability in the manufacture of paper, it has general applicability to any sheet, i.e. web, material where a similar situation prevails.

To attain smaller size paper rolls, the large mill size roll may be processed by unwinding the paper from the large roll, slitting the paper lengthwise to form a plurality of web strips of proper width, and rewinding the slit web strips in a rewinding device into individual rolls on respective ones of a plurality of axially aligned cores of suitable length. The width of each of the slit web strips corresponds to the length of the core on which the particular strip is wound. Overlap of paper between adjacent rolls on the rewinding device obviously cannot be tolerated and, for this reason, the slit web strips are spread apart by means of one or more spreader rolls or bars.

Heretofore there have been numerous and varied structures proposed for spreading unslit travelling webs to full width. By way of example, U.S. Pat. Nos. 3,786,975 and 3,848,304 are referred to, disclosing variable curvature beams or rolls.

By way of example of prior slit web spreaders, U.S. Pat. No. 3,645,433 is referred to as representative of the so-called fan type wherein a web slit into multiple widths or strips has the web strips diverted generally fanshape. For at least certain conditions, number of slits, paper grade, etc., such a spreader is not suitable, or for other reasons it is preferred to have the web strips return to parallel running relation with the original web. For this purpose a two bar arrangement such as disclosed in U.S. Pat. No. 3,463,377 is of particular value. In the latter form of spreader the web strips are fanned-out a limited amount in travelling over the first spreader bar and then in running over the second spreader bar are returned to a parallel running direction, thus effecting the desired spaced relationship between adjacent web strips.

However, a problem with the devices disclosed in these patents has been that where significant web thickness, bulk or length variations are encountered, there has been a tendency for the web material to run out of control, e.g. slit strips may tend to interweave or corrugate due to localized uneven tension resulting from the thickness, bulk or length variations.

It is therefore an important object of the present invention to overcome the problem of web thickness, bulk, length (baggy area) variations in the operation of slit web material controlling devices.

Another object of the invention is to provide a new and improved method of and means for adjusting a web material controlling device to compensate for variations in web thickness, length or bulk.

A further object of the invention is to provide a new and improved slit web material controlling device in which the web material is run on a bar structure providing limited wrap area means, and in which the bar structure is adapted for a primary bowed relation to the web material, and the wrap area means are adapted for effecting secondary adjustments for compensating for variations in web thickness, bulk or length in any part of the web material.

The present invention provides a device for widthwise control of web material and adapted to be operatively disposed between a web material source and other processing equipment, and comprising: a bar structure having elongate resiliently bendable mounting beam means, and limited wrap area means carried by said beam means and adapted to have web material run thereon; means for effecting resilient primary bow bending adjustment of said beam means in respect to the web material so that said wrap area means will have a widthwise controlling effect on the running web material; said wrap area means comprising a set of side-by-side independent but cooperatively related wrap area members which are adjustable relative to one another and relative to said beam means; and means adjustably mounting said members on said beam means and adapted for individually selectively adjusting any of said members relative to said beam means to effect secondary bow adjustments of said wrap area means incrementally at any of said members, without altering said primary bow relation, for compensating for uneven tension in any part of the web material, such as may be caused by variations in web thickness, bulk or length.

In specific implementation of the foregoing, the independent but cooperatively related wrap area members are adjustably mounted on the beam means for individually selectively adjusting any of the members relative to the beam means in direction parallel to the plane of the primary bow for effecting the secondary bow adjustments.

In a spreader capable of fanning and then returning the split strips of the web material to a spread apart generally parallel relationship, a dual bar arrangement may be employed in which the split web strips are initially fanned by a spreader bar having only a primary bow adjustment, followed by a bar structure as described above having primary and secondary bow adjustment capability and adapted for controlling the web strips from the fanned spread relation into substantially parallel relationship.

There is also provided by the present invention a method of operating a web material controlling device which is adapted to be operatively disposed between a web material source and other processing equipment, comprising: running web material across a bar structure having elongate resiliently bendable mounting beam means and limited wrap area means carried by said beam means and comprising a set of side-by-side individually adjustable independent but cooperatively related wrap area members; resiliently bending said beam means and thereby effecting a primary bow relation of said spreader bar structure in respect to the web material running on said members and effecting widthwise control of the material; and individually selectively adjusting any of said wrap area members relative to said beam means and thereby effecting secondary adjustments of said wrap area means incrementally at any of said members, without altering said primary bow relation, and thus compensating for uneven tension in any part of the web material, such as may be caused by variations in web thickness, bulk or length.

In a preferred mode of carrying out the method, the individually selectively adjusting of any of the wrap area members relative to the beam means is effected incremental in direction parallel to the plane of the primary bow.

Further, separated strips of the web material may be successively run on and between a spaced pair of bar structures carried by frame means, rotary adjustments of the frame means effected about an axis extending longitudinally and substantially parallel relative to and between the bar structures, fanning separation of the strips being effected on one of the bar structures, and substantially parallel spaced orientation of the strips being effected on the other of the bar structures in the manner hereinbefore set forth.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure and in which.

Figure 1:
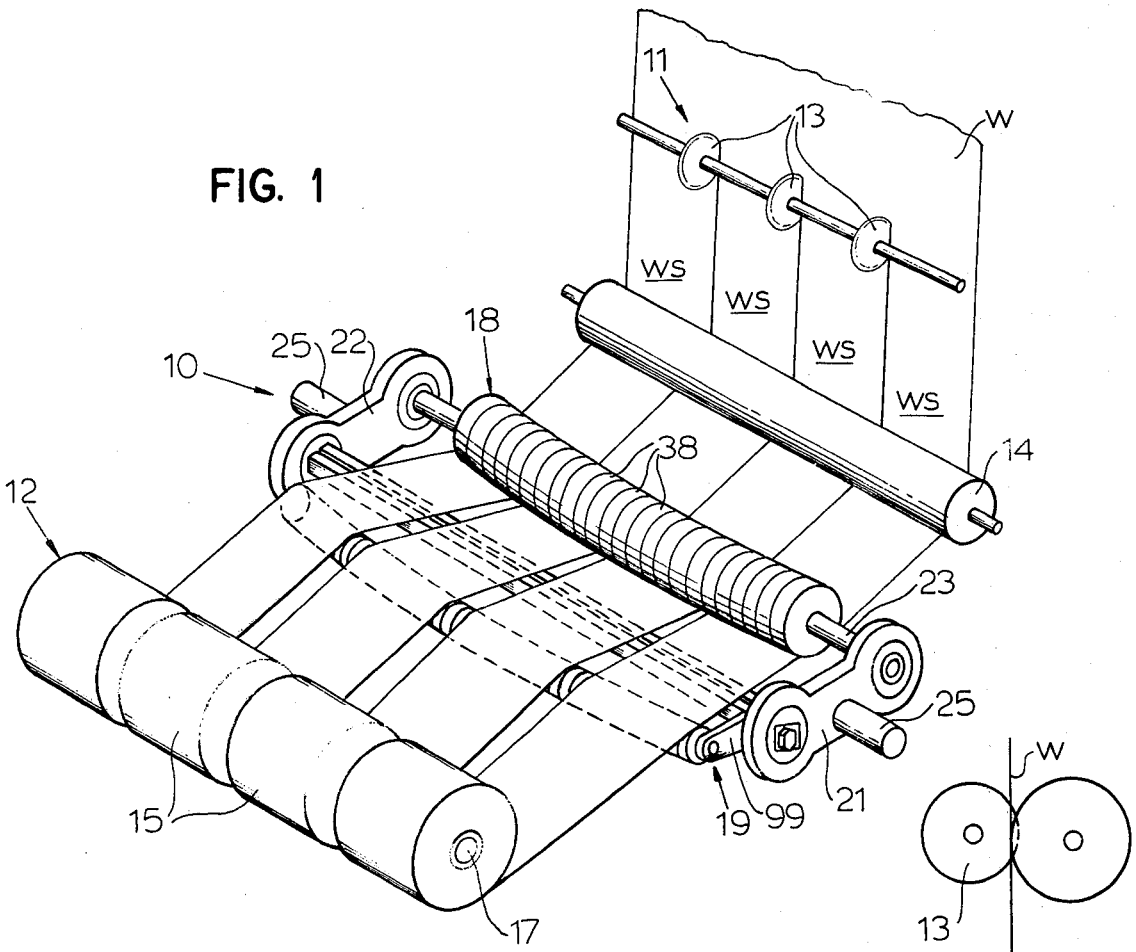
FIG. 1 is a schematic perspective view showing a web material controlling device embodying the invention.
Figure 1:
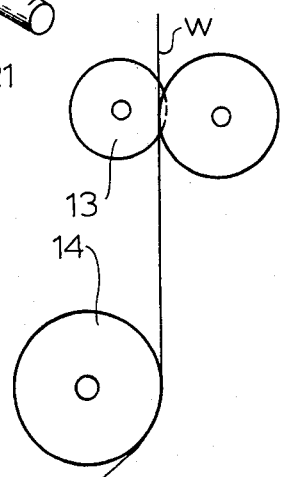
Figure 2:
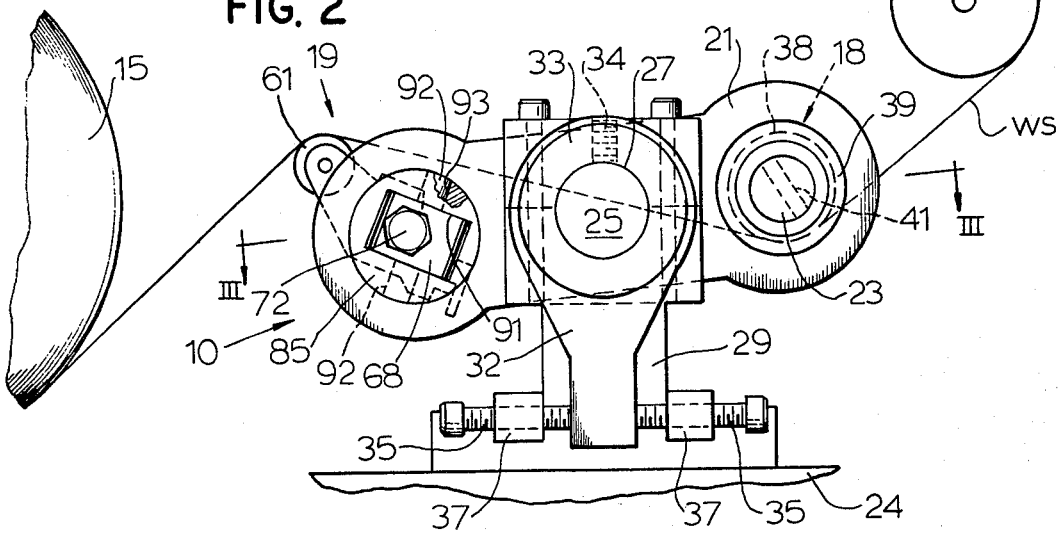
FIG. 2 is an enlarged side elevational view of the device.

As depicted in FIGS. 1 and 2, a representative web material controlling device 10 embodying the present invention may be in the form of a spreader adapted to be operatively located between a slitter 11 and a drum wrap winder 12. There may be other processing equipment in the system if preferred. As shown, web material W is advanced from source such as a stock roll or directly from a papermaking machine to the slitter 11 where slitter blades 13 slit and divide the web W longitudinally into web strips WS. Beyond the slitter 11, the web strips WS may pass about a straight guide roller 14 and enter the device 10, wherein the strips are spread apart a desired distance and then travel on in the spread apart condition to the winder 12 where the strips are wound into respective rolls 15 on individual cores 17.

Although the device 10 may comprise a single bowable bar arrangement where that is feasible, the device as shown is of dual bar arrangement in which two bar structures are cooperatively related in a manner to have a dual widthwise controlling effect on the running web material, for example, a generally fanning spreading of the strips WS by the first of the bar structures in the travel sequence of the strips WS through the spreader 10 and then orientation of the strips into substantial parallelism by the second of the bar structures, to facilitate winding of the rolls 15 onto their cores 17 which may thus be carried by a common mandrel. In this dual bar spreader arrangement, the split strips WS after leaving the guide roller 14 are engaged by a strip fanning bar structure 18 and then by a strip paralleling bar structure 19 from which the substantially parallel spaced strips WS pass to the individual wound rolls 15.

Means for supporting the bar structures 18 and 19 in spaced coextensive relation transversely relative to the web strips WS comprise a frame structure having spaced aligned end frame members 21 and 22 each elongated in the direction of travel of the web strips WS. Opposite end portions of shaft means 23 of the bar structure 18 are mounted on upstream ends of the frame members 21 and 22. Opposite end portions of the bar structure 19 are mounted on downstream ends of the frame members 21 and 22.

Means are provided for mounting the frame members 21 and 22 in the associated machine assembly, and particularly machine frame means 24 (FIG. 2), in a manner to permit joint adjustment of the spreader bar structures 18 and 19 relative to the path of travel of the web strips WS. To this end, the frame members 21 and 22 are provided intermediate their lengths with respective coaxial, oppositely projecting trunnions or stub shafts 25 (FIGS. 1-3) fixed to and extending outwardly from each of the members on an axis extending longitudinally in substantially parallel relation between the bar structures 18 and 19. Each of the stub shafts 25 has an elongate reduced diameter extension 27 supported by and extending outwardly beyond a pillow block type of split bearing 28 carried by a pedestal mount 29 secured as by means of bolts 30 to the machine frame 24. Respective shoulders 31 at the outer ends of the larger diameter portions of the stub shafts 25 cooperate with the split bearings 28 to retain the spreader bar assembly 10 against drifting laterally relative to the path of movement of the web strips WS.

For maintaining the spreader bar structure assembly 10 in any preferred adjustment effected pivotally about the axis of the stub shafts 25, each of the stub shaft extensions 27 is equipped with a laterally extending arm 32 which is desirably provided with an eye head 33 in closely slidable engagement with and about the associated shaft extension 27 and is retained releasably, but fixedly, in any desired adjusted relation relative to the shaft extension 27 as by means of a set screw 34. The arm 22 extends between coaxial adjustment screws 35 threaded through respective bosses 37 on the pedestal 29. Through this arrangement, primary or major rotary adjustments of the spreader bar assembly 10 are adapted to be effected by relative rotatable orientation of the arms 32 on the stub shafts 25 and then fixing the arms to the stub shafts by means of the set screws 34. Fine trim adjustments are adapted to be effected by means of the adjustment screws 35.

In a preferred arrangement, the fanning bar structure 18 may be of the type covered in U.S. Pat. No. 3,645,433 assigned to the same assignee as the present application, and which patent is incorporated herein by reference. Accordingly, the fanning bar structure 18 comprises a roller having a plurality of axially aligned segments 38 which are freely rotatably mounted on suitable bearings **38*a* on and along the shaft means 23. Each of the roller segments 38 may be circumferentially grooved to minimize entrapment of air between the segments and the web strips WS. At one end, herein the end supported on the frame member 21, the shaft means 23** is secured for fixed rotary adjustment and against axial displacement, having fixed thereto a universal ball joint configuration 39 mounted in a race ring 40 to which the ball element 39 is connected for limited swivelling movement about the axis of a pin 41. The ring 40 is operatively locked in any preferred rotary adjusted position by means of a set screw 42 carried by the adjacent end of the frame member 21 and extending to the ring 40 which is mounted in a complementary bore 43 between a shoulder 44 at one end of the bore and a replaceable locking ring 45 at the opposite end of the bore and secured in place by means of screws 47.

At the opposite end of the fanning bar structure 18, means are provided in association with the shaft means 23 for effecting selective bowing of the bar structure. For this purpose a head member 48 is carried by the frame member 22 and has a cylinder 49 therein within which is reciprocably mounted a piston 50 which has projecting rigidly therefrom through an open inner end of the cylinder 49 a ram pin 51. This pin extends into a blind end bore 52 in the adjacent end of the shaft means 23 and thrusts against a shoulder 53 at the blind end of the bore so that when hydraulic pressure is applied to the head of the piston 50 at the blind end of the cylinder 49 as by means of a suitable hydraulic system 54, controlled bowing of the bar 18 is effected. For retaining the head 48 against axial displacement while permitting swivelling to accommodate movement of the adjacent end of the bar structure 18 when bow generating thrust is applied by the piston 50, the head is desirably provided with a universal ball joint configuration engaged in a complementary race ring 57 received in a complementary socket 58 in the frame member 22 and within which the ring is replaceably locked by a retainer ring 59 secured as by means of screws 60. Through this arrangement, bowing of the fanning bar structure 18 can be oriented and controlled relative to the wrap area of the web strips WS running on the rollers 38 to attain the desired fanning separation of the web strips.

After the web strips WS leave the limited wrap area provided by the rollers 38 of the fanning bar structure 18 and have attained the desired fanned separation (FIG. 1), the strips run across the strip-paralleling bar structure 19 which has independent, cooperative web strip paralleling roller means 61 mounted on elongate bowingly bendable beam means 62. By this the web material strips WS are brought into substantially parallel spaced relation before travelling to the windup rolls 15.

Although the beam means 62 may comprise a single resiliently bendable bar, a desirable construction comprises an elongate body assembly of substantially coextensive generally rectangular cross-section bars considered transversely to the axis of the body assembly and having a main bar beam 63 and an auxilliary bar beam 64. Each of the bar beams 63 and 64 is desirably of rectangular cross-section transversely to its axis and stiffly resiliently bendable transversely to its axis in one plane and strongly resistant to bending transversely to its axis on a plane normal to the bending plane. This is accomplished by having the bar beams of narrower dimension in their bending plane and wider in their dimension in the bend-resistant plane as best visualized in FIG. 4. In assembly, the beams 63 and 64 have one of their ends mounted in one end of a cylindrical terminal member 65 which has a transverse mounting slot 67 in such end in which the associated ends of the beams 63 and 64 are coterminously engaged and permanently fixed in any suitable manner such as by welding where the beams and the member 65 are formed of steel or other weldable material. In the mounted relation, the beams 63 and 64 are desirably spaced apart a suitable distance and are oriented in substantially parallel relation with their widest dimensions coextensive.

At their opposite ends, the beams 63 and 64 are related in a manner to permit thrusting of the beam 64 endwise relative to the beam 63 in a manner to apply bending stress to both of the beams by virtue of their common bending plane orientation in the assembly. For this purpose, one of the beams, herein the beam 63, has an integral elongate head 68 comprising a thickness offset relative to the face of the beam 63 which opposes the companion beam 64. At its inner end, the head 64 has a recess 69 defined at its side opposite the body of the beam 63 by a rigid inwardly projecting flange 70 of limited length and providing a retainer for the associated free end of the beam 64.

Means for effecting a primary bow relation of the spreader bar structure 19 in respect to the web strips WS so that the strips will be guided into substantially parallel spaced relation over the wrap area means rollers 61, comprise a threaded shank thrust bolt 71 having an outer end wrench faced head 72 with an integral stop shoulder 73. The shank of the bolt 71 is threadedly engaged in a tapped bore 74 aligned with the recess 69. For its intended purpose, the threaded shank of the bolt 71 is longer than the length of the bore 74 so that an inner end conical tip portion 75 of the bolt is operatively engageable in beam alignment retaining relation in a complementary shallow bearing recess 77 in the adjacent end of the beam 64. In an initial or normal substantially straight orientation of the spreader bar structure beams 63 and 64, the associated end of the beam 64 is desirably close to the bottom of the recess 69. Then by driving the bolt 71 inwardly so that its tip thrusts against the end of the beam 64, a bending stress reaction is developed which results from the bolt 71 thrusting the beam 64 outwardly relative to the recess 69. This causes both of the beams 63 and 64 to bend substantially equally and in the same direction since the beam 64 is held captive in substantially parallelism to the beam 63 by virtue of the anchorage of one of the ends of the beams on the member 65, and the retained cooperation of the opposite ends of the beams by the head 68 and more particularly the retaining flange 70 relative to which the associated end of the beam 64 is slidable in longitudinal direction. To avoid overstressing of the beams 63 and 64, the stop shoulder 73 of the bolt 71 is engageable with the confronting outer end surface of the head 68 after a predetermined maximum inward, beam bowing driving of the bolt 71.

Figures 3, 4, 5:
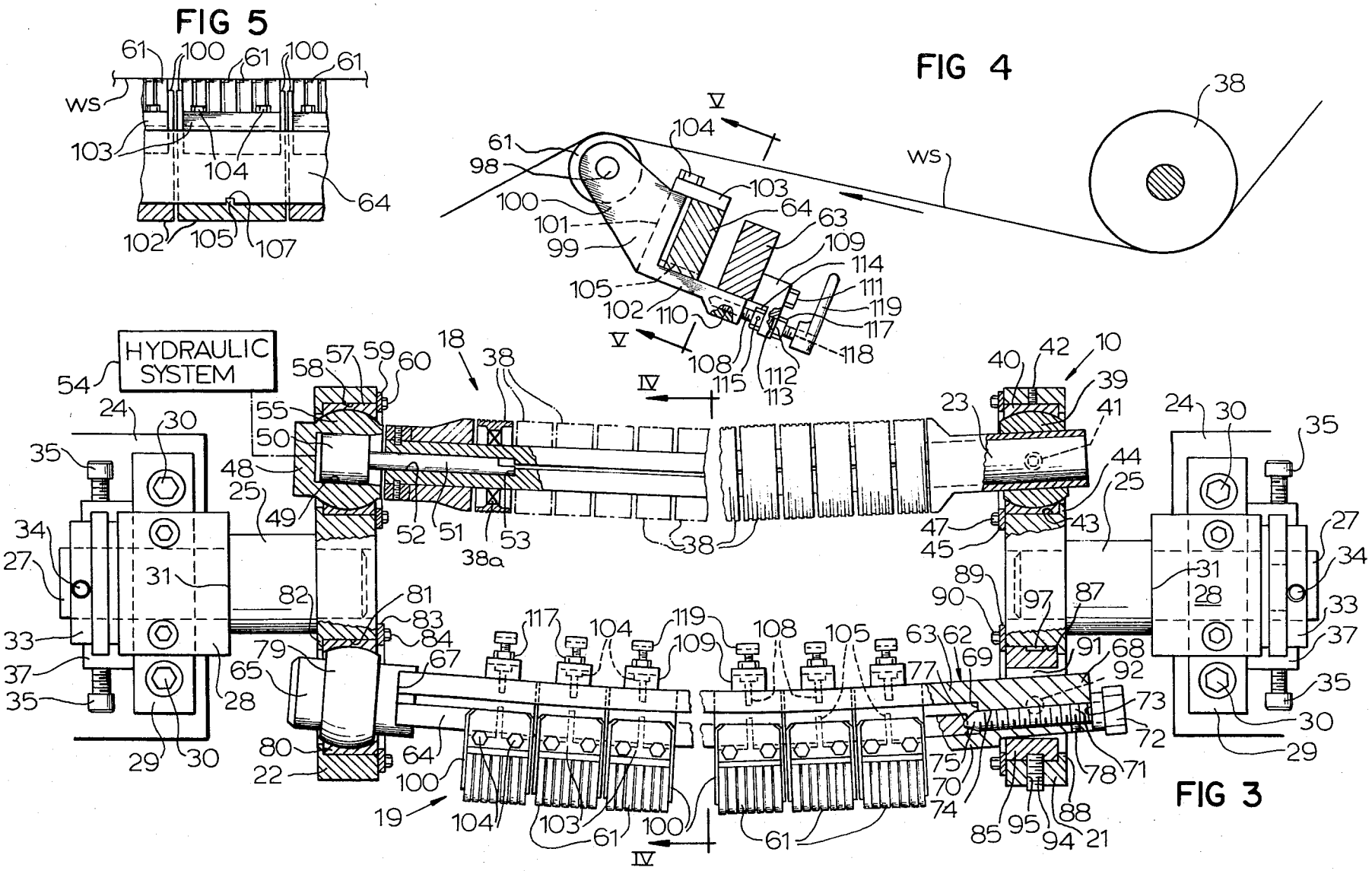
FIG. 3 is a sectional plan view taken substantially along the line III—III of FIG. 2.
FIG. 4 is a sectional detail view taken substantially along the line IV—IV of FIG. 3.
FIG. 5 is a fragmentary sectional detail view taken substantially along the line V—V of FIG. 4.

In FIG. 3, it will be noted that the stop shoulder 73 is shown as bottomed against the end of the head 68, in a maximum bending thrust relationship of the bolt to the beam 64. It will be appreciated that a primary bow relationship of the spreader bar structure 19 is adapted to be controlled by means of the bolt 71 within a substantial range from minimum bow to maximum bow. In any adjusted bow generating position, the bolt 71 is adapted to be locked as by means of a set screw 78 extending on a normal axis thereto in the head 68.

Mounting of the spreader bar structure 19 in its operative position is in the downstream end portions of the frame members 21 and 22, and with the terminal member 65 being supported by the frame member 22 and the beam head 68 being supported by the frame member 21. Means for facilitating not only primary bow adjustments of the bar structure 19, but also rotary adjustments about its axis, comprise substantially universal joint assemblies for supporting the beam assembly 62 in respect to the frame members 21 and 22. To this end, the terminal member 65 is provided with a universal ball joint configuration 79 about its perimeter and which may be a collar fixedly secured thereto in any preferred manner, or may be an integrally machined portion of the end member 65. A ball joint race ring 80 swivally engages the ball joint configuration 79 and is operatively locked in a complementary bore 81 in the frame member 22. A thrust shoulder 82 at one end of the bore 81 and a retaining shoulder plate ring 83 secured by means of bolts 84 to the opposite side of the frame member 22 in retaining relation to the race 80, hold the race fixedly, rotatably and replaceably in the bore 81. Adjustable but lockable swivel mounting for the head 68 in the frame member 21 comprises a swivel disk 85 which is mounted rotatably in a complementary socket bore 87 in the frame member 21 and is retained against axial displacement between an integral annular shoulder 88 at one end of the bore 87 and a replaceable retaining ring plate 89 secured to the opposite face of the frame member 21 as by means of bolts 90. As best seen in FIGS. 2 and 3, the head 68 is of preferably rectangular cross-section across its axis and the swivel disk 85 has a guide slot 91 therein which is defined by opposite spaced bearing surfaces slidably engaging with complementary bearing surfaces on the associated head and which extend in planes parallel to the opposite narrow edges of the beams 63 and 64. Further, the slot 91 is longer than the dimension of the head 68 in its offset direction relative to the beam 63, so that clearance is provided for swivelling of the head 85 in the direction of the length of the slot 91 to accommodate primary bow adjustments of the spreader bar structure 19.

For retaining the head 68 against axial displacement relative to the swivel disk 85, the head is provided with coaxial oppositely extending trunnions 92 having their axes extending parallel to the widest dimension of beam assembly 62. The trunnions 92 are journaled in respective complementary bearing bores 93 in the swivel disk 85 and maintain the head 68 substantially centered relative to the length of the associated bearing slot 91. Thereby, the head 68 is not only retained positively against axially displacement relative to the associated swivel mounting disk 85, but is also adapted for pivotal movement about the axis of the trunnions 92 to facilitate bow adjustment of the spreader bar structure 19. Infinite adjustment of the spreader bar structure rotatably about its axis is efficiently accommodated by the swivel mount 79, 80 at one end and the rotary swivel mount disk 85 at the opposite end. Any desired adjusted position of the spreader bar structure 19 about its axis is adapted to be maintained fixedly, but releasably, by means such as a set screw 94 threaded through a bore 95 in the frame member 21 and aligned with and extending into a peripheral annular set screw groove 97 in the mounting disk 85 for releasable locking end thrusting engagement with the disk 85.

Each of the wrap area rollers 61 may be replaced by a curved stationary but relatively adjustable wrap surface, but the roller arrangement permits higher speed operation with minimal frictional resistance even though the rollers 61, similarly as the rollers 38, are free running with the web strips WS. Each of the roller members 61 provides a circumferentially grooved, circumferential wrap area which rotates with the web strip WS travelling in engagement therewith. Each of the rollers 61 is independently rotatably mounted by means of a respective shaft 98 to a mounting bracket 99 (FIGS. 3, 4 and 5) which is provided with coextensive spaced parallel ears 100 for this purpose. Each of the brackets 99 is preferably substantially identical with respect to each of the other brackets in the entire set of wrap means rollers 61 and, therefore, a description of one will suffice for all of the others.

Means are provided for mounting the bracket 99 in each instance on the associated spreader bar beams 63 and 64 in a manner to permit adjustment of the bracket transversely relative to the beam assembly 62. For this purpose, the bracket 99 has a substantially L-shaped body including a base 101 adapted to lie alongside the wide dimension of the beam 63, and a right angular flange 102 which is adapted to engage slidably with coplanar narrow edges of the beams 63 and 64. As best seen in FIGS. 3 and 4, the brackets 99 are mounted on the beam assembly 62 to orient the rollers 61 in the downstream direction from the beam assembly having regard to the direction of travel of the web strips WS. Thus, the flanges 102 of the brackets 99 engage with the lower coplanar faces of the beams 63 and 64, and the roller supporting ears 100 are directed generally upwardly and downstream as best seen in FIG. 4 so that the wrap sector of each of the rollers 61 faces upwardly.

Each of the brackets 99 carries on the opposite side from the flange 102 a replaceable retainer plate 103 secured to the bracket body base portion 101 as by means of bolts 104. For retaining the bracket 99 in place against displacement longitudinally relative to the beam assembly 62, the inner face of the flange 102 is provided with a key 105 which engages in a complementary keyway 107 formed for the purpose across the contiguous lower surface of the beam member 64.

Means are provided for adjusting each of the wrap area roller members 61 individually relative to the associated beam assembly 62 to effect secondary adjustments of the wrap area provided by the rollers at any of the rollers 61 without altering the primary bow relation that may be present in the spreader bar assembly structure 19 as attained by manipulation of the associated primary bow adjustment screw 71. Such individual adjustment of the wrap area members or rollers 61 is advantageous for compensating for uneven tension in any of the web strips WS as may be caused by variations in web thickness, bulk or length. To this end, adjustment screw means comprising a screw 108 is carried by a bracket 109 and is threaded into a tapped bore 110 in the free edge of the roller supporting bracket flange 102. Desirably, the adjustment screw bracket 109 is secured as by means of bolts 111 to the beam 63. The bracket 109 has an adjustment screw supporting flange 112 which opposes the end of the associated roller bracket flange 102 in spaced relation and has a bore 113 through which the shank of the adjustment screw 108 extends freely. At the inner side of the flange 112 a collar 114 is secured as by means of a pin 115 to the screw shank. At the outer side of the flange 112, a lock nut 117 is threaded on that portion of the shank of the screw 108 which projects outwardly a substantial distance beyond the lock nut 117 and has a flatted terminal portion 118 onto which a manipulating handle 119 is engageable for turning the screw 108. By loosening the lock nut 117 and manipulating the handle 119 to turn the screw 108, fine trimming adjustment of the bracket 99 and thereby the associated roller 61 transversely relative to the beam assembly 62, as guided by the key 105, is adapted to be effected. Upon attaining the desired adjustment, the lock nut 117 is tightened whereby the flange 112 is clamped tightly between the collar 114 and the lock nut 117 and the screw 108 secured fixedly in the selected adjusted position for maintaining the bracket 99 and the associated roller 61 in the desired adjusted position. It will be appreciated that instead of having one of the handles 119 releasably engageable with the terminal 118 of any selected one of the adjustment screws 108, each of the terminals 118 may be equipped with its own handle 119. In any event, only a small or limited adjustment may be needed with respect to any of the brackets and associated rollers 61 during any production run. It will be appreciated that for economy of parts, a single handle 119 may suffice to adjust any selected one or more of the brackets 99 as may be desirable for optimum results.

In setting up the slit web spreader 10 for operating on any particular grade of web W, and in particular paper web, each of the spreader bar structure assemblies 18 and 19 is adjusted to a desired position relative to the other of the spreader bar structure assemblies to attain the spreading results desired for the particular web W having regard to the weight or gauge thickness of the running web. By adjusting the spreader bar frame 21, 22 the desired primary tension of the web strips WS running through the spreader can be attained.

Bow adjustment of the first bar structure 18 determines the degree of fanning separation of the web strips WS. For heavy paperboard, because of its non-elasticity, very little bow is required, while for lighter grades of paper, a greater degree of bow may be required.

Primary bow adjustment of the beam assembly 62 of the second bar structure 19 determines the spaced parallel relation of the web strips WS as diverted by the rollers means 61 from the fanned separation of the web strips. Initially, the wrap area means rollers 61 are adjusted to a uniform bow position on the beam means 62, assuming a uniform spreading of the web strips WS. Upon detection of uneven tension in any of the web strips, such as may be caused by variations in web thickness, bulk or length, the particular wrap area means roller or rollers 61 involved may be readily individually, selectively adjusted to compensate for the uneven tension at any time without shutting down the machine, so that substantially uniform spreading function of the apparatus is maintained.

The means provided herein for effecting the several adjustments of the spreader bar structure, enables quick and easy, accurate and efficient attainment of the desired results.

While the web strips spreader 10 of the present invention is useful for any paper grade, it is especially useful on heavy board and coated papers.

The rollers 38 of the bar assembly 18, and the rollers 61 of the bar assembly 19 provide for substantially anti-friction tracking of the web strips and avoid marking the strips.

As best viewed in FIG. 2, it will be observed that the bowed direction of the roller 61 is substantially downstream relative to the direction of movement of the web strips WS and the wrap area engaged by the web strips is located predominantly at one side of the bow axis rather than at the maximum bow arc line, resulting in efficient substantially parallel orientation of the web strips as they run against the rollers 61.

Incremental, fine trimming adjustments of rollers, as adapted to be effected through the screw means 108, is in direction parallel to the plane of the primary bow adjustment of the beam assembly 62.

In suitable circumstances, the bar structure 19 may be employed by itself or in a proper orientation for controlling unslit web material, for example, to maintain running alignment. In such an arrangement the individually adjustable rollers 61 will be effective, as described hereinbefore, to compensate for uneven tension in any part of the web material, such as may be caused by variations in web thickness, bulk or length.

It will be understood that variations and modifications may be effected without departing from the spirit and scope of the novel concepts of this invention.

We claim as our invention:

1. A device for widthwise control of web material and adapted to be operatively disposed between a web material source and other processing equipment, and comprising:

a bar structure having elongate resiliently bendable mounting beam means, and limited wrap area means carried by said beam means and adapted to have web material run thereon;

means for effecting resilient primary bow bending adjustment of said beam means in respect to the web material so that said wrap area means will have a widthwise controlling effect on the running web material;

said wrap area means comprising a set of side-by-side independent but cooperatively related wrap area members which are adjustable relative to one another and relative to said beam means;

means adjustably mounting said members on said beam means and adapted for individually selectively adjusting any of said members relative to said beam means to effect secondary bow adjustments of said wrap area means incrementally at any of said members, without altering said primary bow relation, for compensating for uneven tension in any part of the web material, such as may be caused by variations in web thickness, bulk or length; and said beam means comprising a plurality of resiliently bendable beam members of substantially rectangular cross-section across their axes, means fixedly connecting one of adjacent ends of said beam members in spaced relation, means relatively longitudinally adjustably connecting the opposite ends of said beam members in spaced relation, said means for effecting primary bow of said beam means comprising means carried by one of said beam members at its said opposite end and operating on said opposite end of the other of said beam members for causing the beam members to bow into a selected primary bowed relation with respect to the web material, said wrap area members comprising rollers, mounting brackets for the rollers mounted on said beam members, and means for effecting adjustments of said brackets transversely relative to said beam members.

2. A method of operating a web material controlling device which is adapted to be operatively disposed between a web material source and other processing equipment, comprising:

running web material across a bar structure having elongate resiliently bendable mounting beam means and limited wrap area means carried by said beam means and comprising a set of side-by-side individually adjustable independent but cooperatively related wrap area members;

manipulating an adjustment screw and thereby resiliently bending said beam means and thereby effecting a primary bow relation of said spreader bar structure in respect to the web material running on said members and effecting widthwise control of the material;

and individually selectively adjusting any of said wrap area members relative to said beam means and thereby effecting secondary adjustments of said wrap area means incrementally at any of said members, without altering said primary bow relation, and thus compensating for uneven tension in any part of the web material, such as may be caused by variations in web thickness, bulk or length.

3. A method of operating a web material controlling device which is adapted to be operatively disposed between a web material source and other processing equipment, comprising:

running web material across a bar structure having elongate resiliently bendable mounting beam means and limited wrap area means carried by said beam means and comprising a set of side-by-side individually adjustable independent but cooperatively related wrap area members;

resiliently bending said beam means and thereby effecting a primary bow relation of said spreader bar structure in respect to the web material running on said members and effecting widthwise control of the material;

individually selectively adjusting any of said wrap area members relative to said beam means and thereby effecting secondary adjustments of said wrap area means incrementally at any of said members, without altering said primary bow relation, and thus compensating for uneven tension in any part of the web material, such as may be caused by variations in web thickness, bulk or length;

said beam means comprising a plurality of resiliently bendable beam members of substantially rectangular cross-section across their axes, said beam members being fixedly connected at one of their ends which are adjacent to one another in spaced relation, and relatively longitudinally adjustably connected at their opposite ends in spaced relation;

effecting primary bow relation of said beam members by manipulating bow adjustment means carried by one of said beam members at its opposite end and acting on said opposite end of the other of said beam members and thereby causing the beam members to bow into a selected primary bow relation with respect to said web strips; and effecting secondary bow adjustments of said wrap area members by adjusting transversely relative to said beam means respective member-mounting brackets carried by said beam means.

4. A device for widthwise control of web material and adapted to be operatively disposed between a web material source and other processing equipment, and comprising:

a bar structure having elongate resiliently bendable mounting beam means, and limited wrap area means carried by said beam means and adapted to have web material run thereon;

means for effecting resilient primary bow bending adjustment of said beam means in respect to the web material so that said wrap area means will have a widthwise controlling effect on the running web material;

said wrap area means comprising a set of side-by-side independent but cooperatively related wrap area members which are adjustable relative to one another and relative to said beam means;

and means adjustably mounting said members on said beam means and adapted for individually selectively adjusting any of said members relative to said beam means to effect secondary bow adjustments of said wrap area means incrementally at any of said members, without altering said primary bow relation, for compensating for uneven tension in any part of the web material, such as may be caused by variations in web thickness, bulk or length;

said beam means comprising a pair of cooperating beam members which have their opposite ends adjacent to one another, the beam members being anchored fixedly relative to one another to one of their ends and being connected for relative longitudinal movement at the other of their ends, and said means for effecting primary bow bending acting to adjust the beam members relatively longitudinally at said other ends for placing the beam members under longitudinal bending stress and causing bending of both of the beam members in the same direction.

5. A device according to claim 4, wherein said means for effecting primary bow bending comprises a thrust screw carried by one of said beam members and thrusting endwise against said other end of the other of said beam members.

6. A device according to claim 4, comprising a second spreader bar structure which has means for effecting a primary bow relation and wrap area means, means for supporting said second spreader bar structure in spaced apart relation to said first mentioned bar structure, one of said spreader bar structures being adapted to receive strips of the web material from a slitter and effect fanning separation of web strips moving across its wrap area means, and the other of said spreader bar structures functioning to effect orientation of the fanned web strips running over its wrap area means into substantially parallel spaced relation.

7. A device according to claim 4, including means for supporting said bar structure with the primary bow directed in downstream relation to the direction of running of separated strips of the web material on said wrap area means, and said wrap area means being oriented relative to the travel of the web material strips for engagement of the strips on a limited wrap area of the wrap area means at one side of the maximum bow arc line defined by said wrap area means as a result of primary bow bending adjustment of said beam means, so that the web material strips travelling in a fan-like separated relation on approach to said bar structure will be oriented into substantially parallel spaced relation as they advance in engagement with said limited wrap area of said wrap area means.

8. A device according to claim 1, wherein said fixed ends of said beam members are mounted in a ball joint swivel means, and the opposite ends of the beam members are mutually supported by means of a swivel structure comprising a rotary disk, head means on one of said beam members pivotally mounted on said disk, and means operatively supporting said ball joint swivel means and said disk.

9. A device according to claim 8, wherein said head means carries an adjustment screw for effecting said primary bow of said beam means.

10. A device for widthwise control of web material and adapted to be operatively disposed between a web material source and other processing equipment, and comprising:

a bar structure having elongate resiliently bendable mounting beam means, and limited wrap area means carried by said beam means and adapted to have web material run thereon;

means for effecting resilient primary bow bending adjustment of said beam means in respect to the web material so that said wrap area means will have a widthwise controlling effect on the running web material;

said wrap area means comprising a set of side-by-side independent but cooperatively related wrap area members which are adjustable relative to one another and relative to said beam means;

means adjustably mounting said members on said beam means and adapted for individually selectively adjusting any of said members relative to said beam means to effect secondary bow adjustments of said wrap area means incrementally at any of said members, without altering said primary bow relation, for compensating for uneven tension in any part of the web material, such as may be caused by variations in web thickness, bulk or length;

said wrap area members comprising web driven rollers; and said means for adjustably mounting said members comprising respective brackets mounting said rollers, said brackets being carried by said beam means, and means for effecting adjustment of said brackets selectively relative to said beam means and relative to each other.

11. A device according to claim 10, wherein said means for effecting adjustments of said brackets comprise a respective adjustment screw operatively associated with each of the brackets.

12. A device for widthwise control of web material and adapted to be operatively disposed between a web material source and other processing equipment, and comprising:

a bar structure having elongate resiliently bendable mounting beam means, and limited wrap area means carried by said beam means and adapted to have web material run thereon;

means for effecting resilient primary bow bending adjustment of said beam means in respect to the web material so that said wrap area means will have a widthwise controlling effect on the running web material;

said wrap area means comprising a set of side-by-side independent but cooperatively related wrap area members which are adjustable relative to one another and relative to said beam means;

means adjustably mounting said members on said beam means and adapted for individually selectively adjusting any of said members relative to said beam means to effect secondary bow adjustments of said wrap area means incrementally at any of said members, without altering said primary bow relation, for compensating for uneven tension in any part of the web material, such as may be caused by variations in web thickness, bulk or length; and a second bar structure having means for effecting a primary bow relation, and wrap area means; frame means mounting both of said bar structures in spaced apart relation, and supporting means for said frame means comprising an arrangement for effecting rotary adjustment of said frame means about an axis extending longitudinally in substantially parallel relation between said bar structures.

13. A device according to claim 12, wherein each of said spreader bar structures has means mounting it on said frame means for relative rotary adjustment about the respective axes of said bar structures.

14. A device for widthwise control of web material and adapted to be operatively disposed between a web material source and other processing equipment, and comprising:

a bar structure having elongate resiliently bendable mounting beam means, and limited wrap area means carried by said beam means and adapted to have web material run thereon;

means for effecting resilient primary bow bending adjustment of said beam means in respect to the web material so that said wrap area means will have a widthwise controlling effect on the running web material;

said wrap area means comprising a set of side-by-side independent but cooperatively related wrap area members which are adjustable relative to one another and relative to said beam means;

and means adjustably mounting said members on said beam means and adapted for individually selectively adjusting any of said members relative to said beam means to effect secondary bow adjustments of said wrap area means incrementally at any of said members, without altering said primary bow relation, for compensating for uneven tension in any part of the web material, such as may be caused by variations in web thickness, bulk or length;

said adjustable mounting of said members on said beam means being such that the incremental adjustments of the members is in direction parallel to the plane of the primary bow effected by bending adjustment of the beam means.

15. A device according to claim 14, wherein said beam means are provided with guide surface means oriented in a direction parallel to the plane of the primary bow, and said means adjustably mounting said member are guided by said surface means.

16. A device according to claim 15, wherein said beam means comprise a plurality of beam members aligned substantially coextensively in the direction of said primary bow, said beam members having said guide surface means as flat surfaces on the beam members.

17. A device according to claim 16, wherein said means adjustably mounting said limited wrap members on said beam means comprise bracket structures carried by said beam members and certain of said bracket structures being guided by said flat surfaces.

18. A device according to claim 17, wherein certain of said bracket structures are fixedly attached to a beam member, and other of said bracket structures are slideably carried by another beam member, and screw means connect the bracket structures and are adapted to effect fine trimming adjustments of the other bracket structures relative to the beam means and thereby effecting said incremental adjustments of said wrap area members.

19. A method of operating a web material controlling device which is adapted to be operatively disposed between a web material source and other processing equipment, comprising:

running web material across a bar structure having elongate resiliently bendable mounting beam means and limited wrap area means carried by said beam means and comprising a set of side-by-side individually adjustable independent but cooperatively related wrap area members comprising web driven rollers;

running said web material in partial wrap relation on said rollers;

resiliently bending said beam means and thereby effecting a primary bow relation of said spreader bar structure in respect to the web material running on said members and effecting widthwise control of the material;

individually selectively adjusting any of said wrap area members relative to said beam means and thereby effecting secondary adjustments of said wrap area means incrementally at any of said members, without altering said primary bow relation, and thus compensating for uneven tension in any part of the web material, such as may be caused by variations in web thickness, bulk or length;

supporting said rollers on brackets; supporting said brackets on said beam means; and effecting adjustment of said brackets selectively relative to said beam means and relative to each other.

20. A method according to claim 19, which comprises operating an adjustment screw in respect to each of said brackets and thereby effecting said adjustment of the brackets relative to the beam means.

21. A method of operating a web material controlling device which is adapted to be operatively disposed between a web material source and other processing equipment, comprising:

running web material across a bar structure having elongate resiliently bendable mounting beam means and limited wrap area means carried by said beam means and comprising a set of side-by-side individually adjustable independent but cooperatively related wrap area members;

resiliently bending said beam means and thereby effecting a primary bow relation of said spreader bar structure in respect to the web material running on said members and effecting widthwise control of the material;

individually selectively adjusting any of said wrap area members relative to said beam means and thereby effecting secondary adjustments of said wrap area means incrementally at any of said members, without altering said primary bow relation, and thus compensating for uneven tension in any part of the web material, such as may be caused by variations in web thickness, bulk or length;

effecting said incremental adjustments of said members in direction parallel to the plane of the primary bow effected by bending adjustment of the beam means; and effecting said incremental adjustments of the members along flat guide surface means oriented in a direction parallel to the plane of said primary bow.

22. A method according to claim 21 wherein said beam means comprise a plurality of beam members aligned substantially coextensively and having thereon said flat guide surface means, and guiding said members on said flat surface means in said direction parallel to the plane of the primary bow.

23. A method according to claim 22, comprising mounting said wrap members on bracket structures carried by said beam members, and guiding certain of said bracket structures on said flat surfaces.

24. A method according to claim 23 comprising fixedly attaching certain of said bracket structures to a beam member and slideably carrying other of said bracket structures on another beam member, and effecting fine trimming adjustments of said other bracket structures relative to the beam means and thereby effecting said incremental adjustments of said wrap area members.

25. A method of operating a web material controlling device which is adapted to be operatively disposed between a web material source and other processing equipment, comprising:

running web material across a bar structure having elongate resiliently bendable mounting beam means and limited wrap area means carried by said beam means and comprising a set of side-by-side individually adjustable independent but cooperatively related wrap area members;

resiliently bending said beam means and thereby effecting a primary bow relation of said spreader bar structure in respect to the web material running on said members and effecting widthwise control of the material;

and individually selectively adjusting any of said wrap area members relative to said beam means and thereby effecting secondary adjustments of said wrap area means incrementally at any of said members, without altering said primary bow relation, and thus compensating for uneven tension in any part of the web material, such as may be caused by variations in web thickness, bulk or length;

said beam means comprising a pair of cooperating beam members which have their opposite ends adjacent to one another, the beam members being anchored fixedly relative to one another at one of their ends and being connected for relative longitudinal movement at the other of their ends, and adjusting said beam members relatively longitudinally at said other ends and thereby placing the beam members under longitudinal stress and causing bending of both of the beam members in the same direction and effecting said primary bow relation.

26. A method according to claim 25, comprising operating a thrust screw carried by one of said beam members and thrusting said screw endwise against said other end of the other of said beam members in effecting said primary bow relation.

27. A method according to claim 25, comprising pivotally adjusting said beam members about the axes of their opposite ends.

28. A method according to claim 25, which comprises manipulating an adjustment screw and thereby effecting said primary bow relation.

29. A method according to claim 25, wherein said wrap area members comprise web driven rollers, and running said web material in partial wrap relation on said rollers.

30. A method according to claim 25, comprising running separated strips of the web material from a fanned relation of the strips into limited wrap engagement predominately on one side of said wrap area means relative to the maximum bow arc line defined by the wrap area means as a result of said primary bow directed downstream with respect to the direction of travel of the strips, and thereby diverting the running strips from the fanned relation thereof into substantially parallel spaced relation.

31. A method according to claim 25 which comprises effecting said incremental adjustments of said members in direction parallel to the plane of the primary bow effected by bending adjustment of the beam means.

32. A method according to claim 25, comprising running separated strips of the web material on a second bar structure carried by frame means which also carries said first-mentioned bar structure, effecting rotary adjustment of said frame means about an axis extending longitudinally and substantially parallel relative to and between said bar structures, effecting fanning separation of the strips on said second bar structure, and effecting substantially parallel spaced orientation of the strips on said first-mentioned bar structure.

33. A method according to claim 32, comprising effecting respective rotary adjustments of said bar structures relative to said frame means about the axes of said spreader bar structures.

* * * * *